United States Patent [19]

Brown et al.

[11] 4,312,711

[45] Jan. 26, 1982

[54] FLUID COOLED QUENCHING CARS

[75] Inventors: Arthur Brown; Kevin F. Murray, both of Keighley, England

[73] Assignee: Norcros Investments Limited, England

[21] Appl. No.: 100,553

[22] Filed: Dec. 5, 1979

[30] Foreign Application Priority Data

Dec. 5, 1978 [GB] United Kingdom ..... 47266/78

[51] Int. Cl.[3] ..... B61D 3/16; B61D 7/08; B61D 7/28; C10B 39/14

[52] U.S. Cl. ..... 202/227; 105/254; 105/396; 105/416; 105/417; 201/39

[58] Field of Search ..... 105/254, 413, 414, 415, 105/416, 417, 418, 419, 396; 201/39; 202/227

[56] References Cited

U.S. PATENT DOCUMENTS

| | | | |
|---|---|---|---|
| 469,868 | 3/1892 | Osbourn | 105/396 X |
| 976,580 | 11/1910 | Krause | 202/227 |
| 1,105,948 | 8/1914 | Wright | 105/254 |
| 2,125,692 | 8/1938 | Ragsdale et al. | 105/416 X |
| 2,792,791 | 5/1957 | Kreissig | 105/416 |
| 3,238,899 | 3/1966 | Gutridge et al. | 105/416 |

FOREIGN PATENT DOCUMENTS

| | | | |
|---|---|---|---|
| 263766 | 9/1913 | Fed. Rep. of Germany | 202/227 |
| 973575 | 3/1960 | Fed. Rep. of Germany | 105/254 |

*Primary Examiner*—Joseph F. Peters, Jr.
*Assistant Examiner*—Howard Beltran
*Attorney, Agent, or Firm*—Leydig, Voit, Osann, Mayer & Holt, Ltd.

[57] ABSTRACT

A quenching car comprises an open-topped body arranged to carry a load to be quenched. At least a part of the body is composed of walls of hollow construction to receive a liquid cooling medium, such as water. The hollow walls comprise inner and outer plate-like layers separated by reinforcing members which lie internally of the hollow walls, whereby the exposed surfaces of the inner and outer layers are substantially smooth and self-draining. The body is supported by girders of box-section extending along the length of the car.

2 Claims, 4 Drawing Figures

FLUID COOLED QUENCHING CARS

BACKGROUND OF THE INVENTION

1. Field of the Invention

The present invention relates to quenching cars.

2. Description of the Prior Art

Quenching cars are used for carrying coke from a coke oven to a spray cooling device in which water is sprayed onto the coke to cool same. Such quenching cars usually comprise an elongate hopper-like body open at its upper side to receive the coke and also to enable the spray of water to be directed onto the coke. The hopper-like body has a floor which is inclined downwardly towards a side of the body having discharge doors in its lower portion which can be opened to permit discharge of the coke after quenching.

In previously proposed quenching cars, the hopper-like body is composed of plates reinforced externally by longitudinal and transverse beams. The body is supported on a lattice girder arrangement which extends along the length of the body. Such previously proposed quenching cars are highly susceptible to corrosion, as water which is sprayed onto the car during quenching and also sulphuric acid, which is produced by the reaction of the quenching water with sulphur in the coke, tends to be trapped by the external reinforcing beams of the hopper-like body and also on the lattice girders, this effect being particularly noticeable at the intersections between individual members of the external reinforcement and of the lattice girders.

SUMMARY OF THE INVENTION

According to one aspect of the present invention, there is provided a quenching car comprising an open-topped body arranged to carry a load to be quenched, at least a part of said body being composed of walls of hollow construction to receive a liquid cooling medium.

According to another aspect of the present invention, there is provided a quenching car comprising an open-topped body arranged to carry a load to be quenched, at least a part of said body being composed of hollow walls comprising inner and outer plate-like layers separated by reinforcing members which lie internally of the hollow walls.

According to yet another aspect of the present invention, there is provided a quenching car comprising an open-topped body arranged to carry a load to be quenched, said body being supported by at least one girder of box-section extending longitudinally of the car.

BRIEF DESCRIPTION OF THE DRAWINGS

An embodiment of the invention will now be described, by way of example only, with reference to the accompanying diagrammatic drawings, in which.

BRIEF DESCRIPTION OF THE PREFERRED EMBODIMENTS

Figure 1:
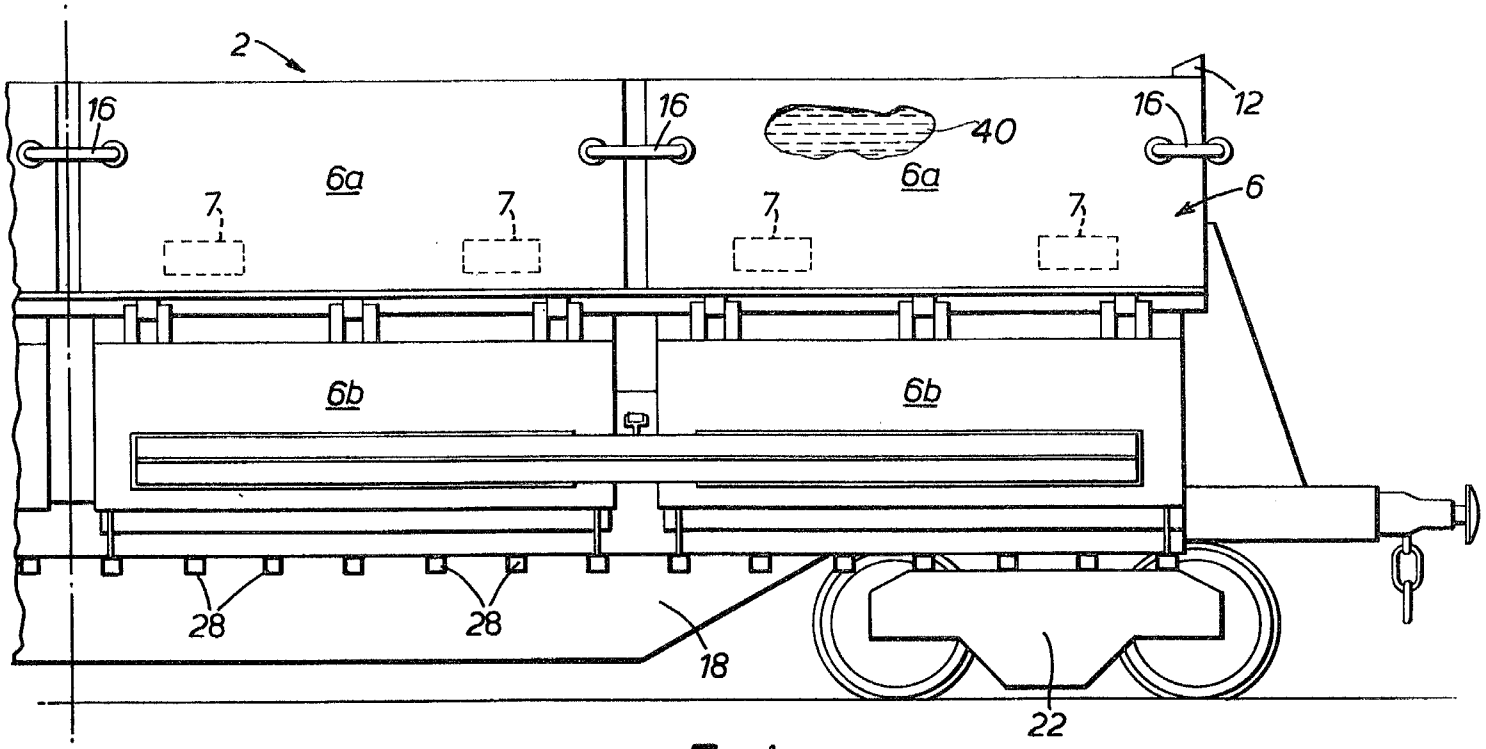
FIG. 1 is a longitudinal elevation showing one half of the front side of a quenching car in accordance with the invention, a portion being broken away to illustrate the hollow wall construction utilized.

The quenching car shown in the drawings comprises an elongate hopper-like body 2 defined by opposed end walls 4, a front wall 6, and an inclined bottom 8 which slopes downwardly from the top of the body at the rear side of the car to the bottom of the body at the front side of the car. In its upper part, the front wall 6 is defined by fixed wall parts **6*a* and in its lower part by doors 6*b* each of which is pivoted about a horizontal axis at its upper edge to permit discharge of the coke from the quenching cars when the doors 6*b* are opened. The doors 6*b* are operated by pneumatic cylinders 10**.

The end walls 4 and the fixed wall parts **6*a* are each of double-layer construction and each comprises inner and outer plates separated by reinforcing beams which are thus located internally of the wall and are therefore not exposed to contact with the corrosive liquids. The front plates of the respective fixed wall parts 6*a*** are independently removable without disturbing the other fixed wall parts.

Figure 2:
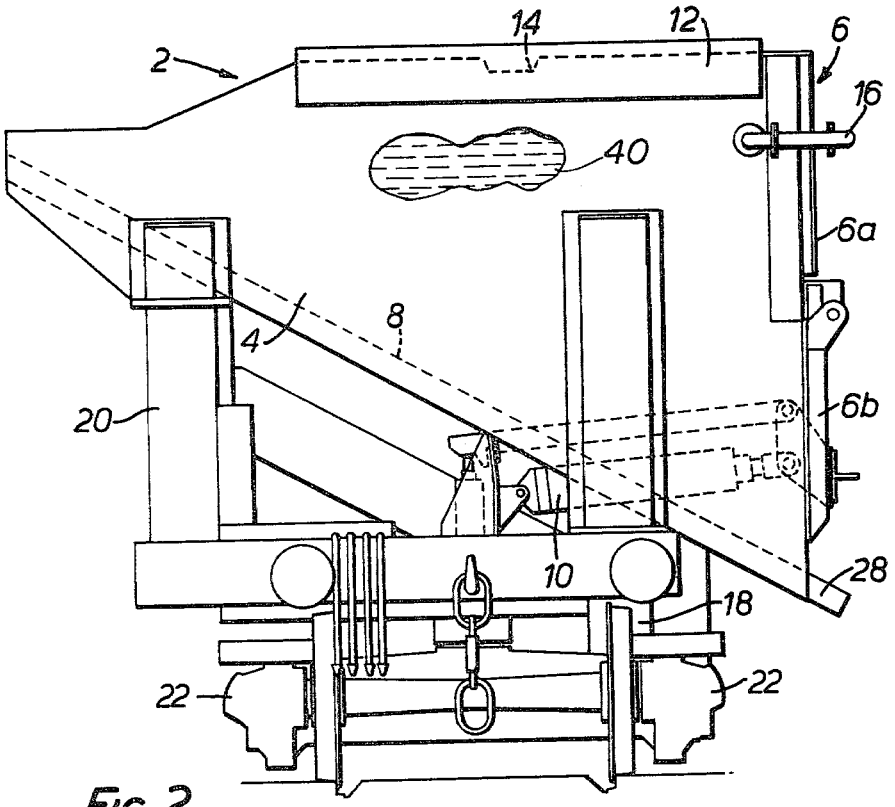
FIG. 2 is an end elevation, to an enlarged scale, of the quenching car shown in FIG. 1, a portion being broken away to illustrate the hollow wall construction utilized.

The double-layer construction of the end walls 4 and front wall parts **6*a* enables these components to be filled with water 40 which acts as a cooling medium to reduce the heating effect whereby the thermal shock due to the rapid heating and cooling cycles is reduced. In FIG. 1, a portion of the exterior layer of the front wall 6*a* is broken away, exposing the cooling water 40 contained in the hollow wall. Similarly, in FIG. 2, a portion of the exterior layer of the end wall 4 is broken away exposing the cooling water contained in that hollow wall. The cooling water is fed into each end wall 4 from an open-topped trough 12 which extends part-way across the width of the end wall 4 adjacent its upper edge. Communication between the trough and the interior of the end wall 4 is effected via a weir defined by a notch cut into the outer layer of the end wall as indicated at 14 in FIG. 2. Water fed into the trough 12 flows across the weir 14 to fill the end wall 4. The interior of the end wall 4 is connected with the interior of the adjacent front wall part 6*a* by means of a pipe 16 located in the upper part of the end wall 4. When the water level in the end wall 4 reaches the pipe 16, the endmost wall part 6*a* will start to fill with water from the end wall 4. The adjacent front wall parts 6*a* are similarly connected by pipes 16 so that all of the front wall parts 6*a* may be filled with water from the end walls 4 via any preceding front wall part 6*a*. The outler layer of each end wall 4 and of each of the front wall parts 6*a* has a number of removable plates 7 as indicated in dotted lines for the left-hand wall part 6*a* in FIG. 1**, to permit access into the interior of these walls for cleaning.

The walls may be filled with cooling water prior to use of the quenching car and the cooling water will be continuosly topped-up by water which is sprayed into the troughs from the quenching jets during quenching of a load carried by the car. The use of a trough/weir arrangement to fill each end wall 4 with water prevents loose pieces of coke from passing into the interior of the walls. Also the flow of water across the weir 14 into the end wall 4 will be a relatively smooth flow which will not cause excessive oxygination of the water whereby corrosion internally of the walls will be reduced.

The inner layer of the end walls 4 and of the front wall parts **6*a*** is formed from a wear and corrosion-resistant steel plate such as that sold by the Creusoit-Loire Steel Company under the Trade Name "CREUSABRO 32" and the outer layer is composed of a corrosion-resistant steel plate such as that sold by the British Steel Corporation under the Trade Name "CORTEN A". In addition to forming a cooling water jacket, the double-layer walls give rise to the important advantage that both the inner and outer surfaces of these walls can be made smooth and self-draining because the reinforcement for these walls is located internally of the walls rather than on the outside and which, as discussed earlier, causes corrosive liquids to be trapped.

The doors 6*b* and the inclined bottom 8 are each composed of solid, wear and corrosion-resistant, plate.

The hopper-like body 2 is supported by front and rear laterally-spaced box-section girders 18 and 20 respectively, which extend along the length of the quenching car. At each end of the car, the two girders 18 and 20 are carried by trucks or bogies 22.

The two longitudinal girders 18 and 20 are connected at each end of the quenching car and in the centre by lateral box-section beams 24. The rear longitudinal girder 20 is located at a higher level than the front girder 18. Lateral support bars 28, likewise of box-section, extend forwardly and downwardly across the tops of the two girders 18 and 20 and act to support the floor 8 of the hopper-like body 2 from the beams 18 and 20.

Figure 4:
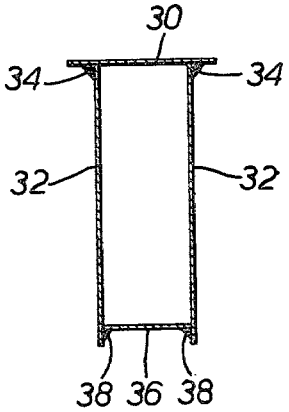
FIG. 4 is a transverse section, to a reduced scale, of a box girder used in the quenching car.

In cross-section, the longitudinal girders 18 and 20 are of the form shown schematically in FIG. 4. As shown in FIG. 4 the upper wall 30 of each girder projects beyond the two side walls 32 to form overhangs which tend to shield welds 34 between the top wall 30 and the side walls 32, whereby direct contact of corrosive liquids with these welds is reduced. For similar reasons, the bottom wall 36 of the girder is located above the lower edge of the two side walls 32 whereby these side walls shield welds 38 between the bottom wall and the side walls. These box-section girders are smooth and self-draining and do not act as traps for the corrosive liquid, and this also applies to the box-section beams 24 and the box-section bars 28.

Figure 3:
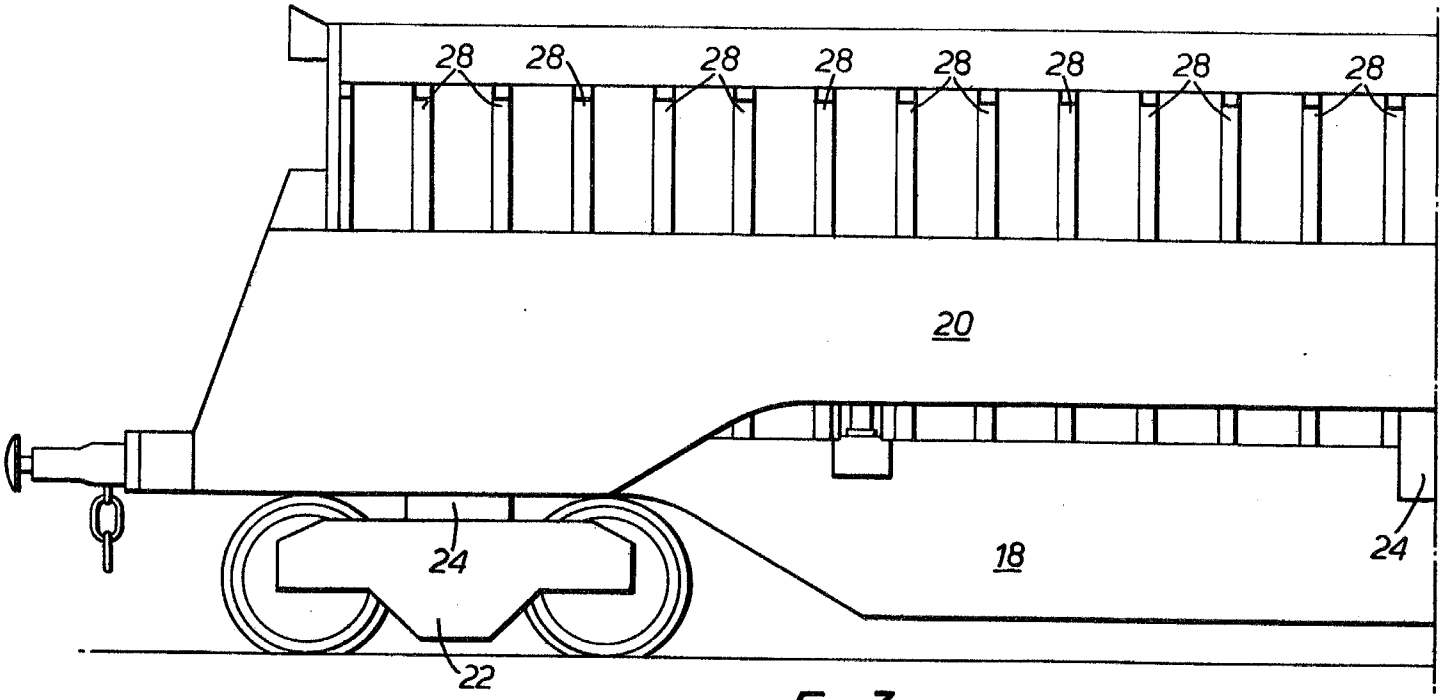
FIG. 3 is a partial longitudinal elevation of one half of the rear side of the quenching car.

As may be seen from FIG. 3, over a substantial portion of its length, the underside of the rear girder 20 is raised in order to facilitate access to the underside of the quenching car for servicing purposes. Likewise, the use of only three transverse beams 24 between the two longitudinal girders permits good access to the underside. This arrangement thus contrasts with the previously proposed quenching cars as discussed above wherein the hopper-like body is supported by a lattice girder arrangement in which the individual components of the lattice severely restrict access to the underside.

What is claimed is:

1. In a quenching car, an open-topped body arranged to carry a load to be quenched, said body comprising opposed end walls, a front side wall, a rear side, and an inclined bottom which slopes downwardly from the top of the body at the rear side to the bottom of the body at the front side wall, the end walls and at least part of the front side wall being hollow, enabling said walls to hold a liquid cooling medium, said hollow walls being comprised of inner and outer plate-like layers separated by reinforcing members which lie in the interior of the hollow walls, an open-topped water-receiving trough mounted on the car adjacent each end wall of the car, each trough being in communication with the interior of the adjacent hollow end wall, and the interior of the two end walls being in communication with the interior of the hollow part of the front wall, whereby the hollow walls can be filled with cooling water via the troughs.

2. In a quenching car, an open-topped body arranged to carry a load to be quenched, trucks, and at least one girder of box-section that extends longitudinally of the car and supports said body on said trucks, said girder being of welded construction and comprising an upper wall, side walls, and a bottom wall, said upper wall overhanging the side walls, and said bottom wall being maintained within said side walls.

* * * * *